US005560153A

United States Patent [19]

Gold

[11] Patent Number: 5,560,153

[45] **Date of Patent: *Oct. 1, 1996**

[54] PIVOTALLY TRAVERSABLE VEHICLE WINDOW

[76] Inventor: Peter Gold, 465 N. Wood Rd., Rockville Centre, N.Y. 11570

[ * ] Notice: The term of this patent shall not extend beyond the expiration date of Pat. No. 5,457,913.

[21] Appl. No.: 574,326

[22] Filed: Dec. 18, 1995

[51] Int. Cl.[6] ..... E05D 15/00

[52] U.S. Cl. ..... 49/381; 49/397

[58] Field of Search ..... 49/381, 397, 400, 49/401, 394, 147; 16/225, 385

[56] References Cited

U.S. PATENT DOCUMENTS

| | | | |
|---|---|---|---|
| 2,507,965 | 5/1950 | Eichner | 49/147 |
| 4,363,191 | 12/1982 | Morgan | 49/381 |
| 4,412,739 | 11/1983 | Freiberg | 16/225 X |
| 4,446,184 | 5/1984 | Bowser | 16/225 X |
| 4,563,381 | 1/1986 | Woodland | 16/225 X |
| 4,584,216 | 4/1986 | Kenworthy et al. | 16/225 X |
| 4,761,916 | 8/1988 | Sanok et al. | 49/381 |
| 4,799,727 | 1/1989 | Robbins et al. | 16/225 X |
| 5,050,663 | 9/1991 | Rhoads et al. | 16/225 X |
| 5,133,108 | 7/1992 | Esnault | 16/225 |
| 5,457,913 | 10/1995 | Gold | 49/381 |

*Primary Examiner*—Kenneth J. Dorner
*Assistant Examiner*—Jerry Redman
*Attorney, Agent, or Firm*—Myron Amer, P.C.

[57] ABSTRACT

A vehicle ventilation side or rear window in a recessed opening to minimize adverse aerodynamic wind resistance and the like, on which the flange periphery which bounds the recess there is deposited a selected amount of urethane which, when cured, advantageously serves both to hold the window in place and also as a flexuring support for an opening pivotal traverse of the window, the angle of the traverse being confined to an extent that does not result in a rupturing of the cured urethane.

3 Claims, 1 Drawing Sheet

PIVOTALLY TRAVERSABLE VEHICLE WINDOW

FIELD OF INVENTION

The present invention relates to improvements in auto ventilation windows, i.e. windows on the sides of the auto, van or the like, which windows cannot project during use beyond a controlled pivotal traverse since such degree of movement is into the path of movement of a passing auto and/or pedestrian, and consequently would create a safety hazard, the improvements more particularly residing in the mounting of such windows to partake of the controlled pivotal traverse for the ventilation purposes intended.

BACKGROUND

Restricted pivotally movable windows in autos are already well known, as exemplified by my prior U.S. Pat. No. 4,638,598 issued on Jan. 27, 1987 for "Force Hinge Connection for the Latching Mechanism of a Panel Truck or Van Window", and in U.S. Pat. No. 4,363,191 issued on Dec. 14, 1982 to Cleon C. Morgan, in both of which the proposed improvements are in the movement-controlling means that restrict the extent of the pivotal traverse of the windows. The windows otherwise, and as is pertinent to the within invention, use conventional hinges which provide or allow for the traversing degree of movement of the windows, and such hinges are unnecessary costly and more complicated than need he, given the circumstances of the operating mode of the windows.

SUMMARY OF THE INVENTION

Broadly, it is an object of the present invention to embody greater simplicity in the hinge mounting of the window, but to achieve the pivotal traversing degree of window movement using to advantage urethane and the construction materials of the auto bounding the window opening, all as will be better understood as the description proceeds. Stated otherwise, underlying the present invention is the recognition that the window opening movement is limited or restricted for the safety reasons noted, and that construction and adhesive materials, i.e. urethane, are available to be selected for the peripheral boundary of the window opening that have a flexuring mode within the parameters of this restricted movement, such that attachment of the window to this flexuring component effectively provides, without attendant rupture, the equivalent of the hinge function.

The description of the invention which follows, together with the accompanying drawings should not be construed as limiting the invention to the examples shown and described, because those skilled in the art to which this invention appertains will be able to devise other forms thereof within the ambit of the appended claims.

Figure 2:
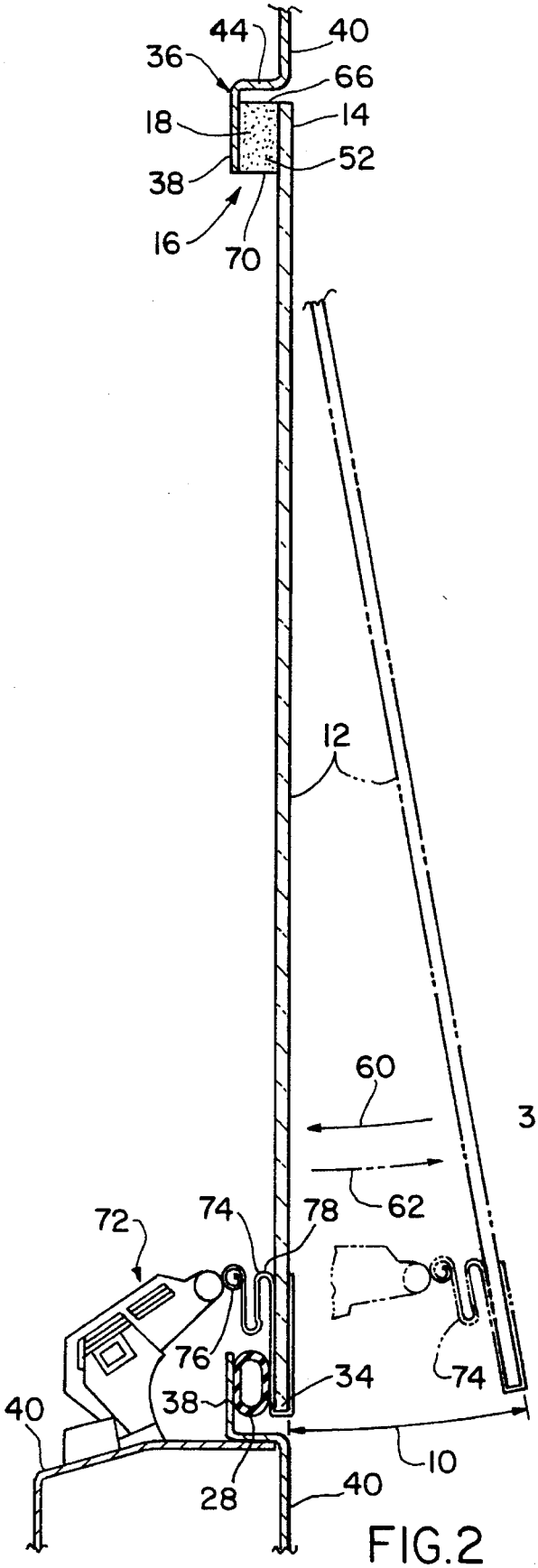
FIG. 2 iS a sectional elevational view, on an enlarged scale, as taken along line 2—2 of FIG. 1, illustrating in full line and phantom line perspective of the pivotal traverse of the vehicle window as permitted by the within inventive hinge.

In my prior patent, U.S. Pat. No. 5,457,913 issued on Oct. 17, 1995 for "Hinge Mounting for Auto Ventilation Window", which by this reference is incorporated herein in its entirety, the limited pivotal traverse 10 of an auto or vehicle window 12 as is necessary to move from a closed position, illustrated in full line, to an open condition, illustrated in phantom, as shown in the '913 patent and also in this application FIG. 2, provides an adequate opening for ventilation and, using this to advantage, it is possible, as was done in the '913 patent, to greatly simplify the construction and operating mode of the hinge connection, as at the window upper end 14. The simplicity of the within hinge, generally designated 16, significantly exceeds that of the '913 patented hinge, and consists of the selection of an adhesive for the top window edge 14 in the specific form of commercially available urethane 18, such as urethane U418-i that is available from Essex Corporation of Dayton, Ohio.

Figure 3:
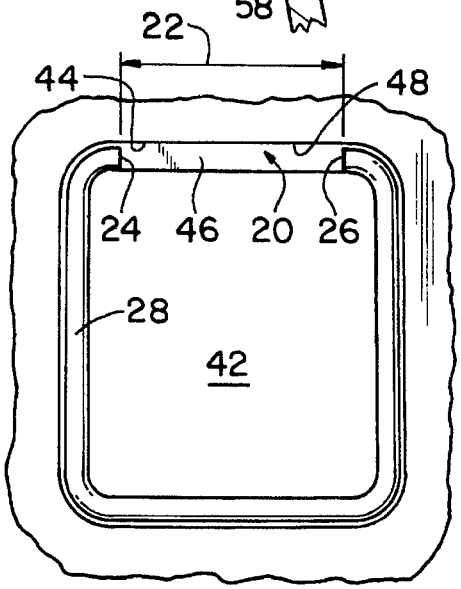
FIG. 3 is a view similar to FIG. 1, but prior to the installation of the inventive hinge for the ventilation window.
Figure 1:
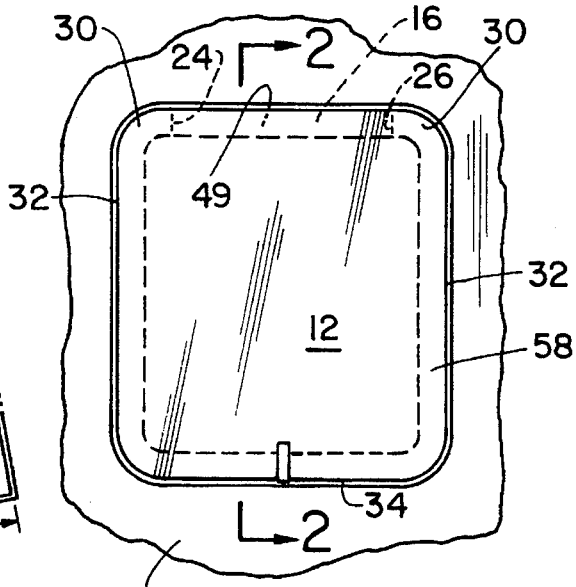
FIG. 1 is a partial exterior perspective view of a vehicle illustrating typical use of the within inventive hinged ventilation window in its closed condition.

More particularly, the urethane 18 is deposited as an uncured viscous mass at a selected site for repository or its placement, designated 20 in FIG. 3, in an amount resulting it its curing, according to a well known and understood chemical process, in a rectangular configuration with a length spanning a distance 22 between opposite facing ends 24 and 26 of an elastomeric gasket 28 extending from window corner locations 30 along opposite window sides 32 and bottom edge 34, said gasket 28 being typically adhesively secured, using butyl, to a flange 36 having an inturned wall 38 which extends below and in substantial parallel relation to the plane of the window opening, depicted by the full line illustration of the window 12, thus providing weather-barrier contact against the window side edges 32 and bottom edge 34.

Figure 4:
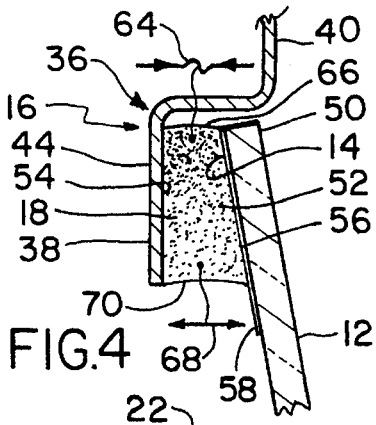
FIG. 4 is a cross-sectional view showing details of the inventive hinge.

Flange 36 which optionally can be integral with the vehicle panel 40 or separately attached, as by welding or the like, to panel 40, serves as a frame for the window opening 42, having a wall 44 in surrounding relation to the window opening 42 and extending transversely thereof to define an L-shaped configuration with the gasket-supporting wall 38. As a consequence, the exposed length portion 46 of wall 38, the coextensive length portion 48 of wall 44, the gasket facing ends 24 and 26, and lastly the length portion 49 of the top glass edge 50 which is positioned in spanning relation between the gasket ends 24 and 26, are effective to form a compartment for shaping the previously deposited uncured urethane mass into a cured rectangular block, designated 52 in FIG. 4. As known, the cured urethane at surfaces 54 and 56 are adhesively secured respectively to the flange wall 44 and glass top 14 having a gasket-masking painted-black border 58 has a retention strength of approximately 1500 pounds per square inch and, in practice, does not result in detachment of the window during back and forth pivotal traverses 60 and 62.

Underlying the present invention is the recognition that the urethane in its block configuration 52 has a flexibility which, in response to applied force, will cause a size reduction or contraction 64 in its far wall 66 and a size increase or stretching 68 it its near wall 70, which permits a degree of movement in the window 12 that constitutes a pivotal traverse 60, 62 within the physical limits permitted by the over-center latch means 72 appropriately mounted on panel 40 and having a spring 74 connected at opposite ends, at 76 and 78, to the latch means 72 and bottom window edge 34.

It has been found in practice that good results are achieved using a urethane rectangular block 52 that is approximately thirteen inches long, approximately one inch wide, as measured between its near and far surfaces 70 and 66, and not less than approximately one half inch in height, as measured between its surfaces 54 and 56. A height that is only nominal and allows correspondingly only nominal contraction 64 and expansion 68 in the cured urethane is of limited utility as a hinge, and heretofore was used only as an adhesive connection between stationary surfaces.

While the auto window hinge mounting embodiment herein shown and disclosed in detail is fully capable of attaining the objects and providing the advantages hereinbefore stated, it is to be understood that it is merely illustrative of presently preferred embodiments of the invention and that no limitations are intended to the detail of construction or design herein shown other than as defined in the appended claims.

What is claimed is:

1. A pivotally traversable vehicle window comprising:

a. Wall means having edges cooperating to bound a rectangular flat planar window opening having a top, a bottom, and opposite sides;

b. A flange serving as a frame for said window opening having a length portion coextensive with said window opening top configurated with a first wall extending transversely of the plane of said rectangular flat planar window opening and an integral second wall extending transversely from said first wall rearwardly of and in substantially parallel relation to said plane of said window opening;

c. Weather-barrier gasket means of elastomeric construction material having two length portions each with an end of a prescribed height and width having operative positions disposed in attached relation to said flange second wall with said gasket opposite ends in spaced relation bounding a clearance of a selected length therebetween substantially at a medial location of said window opening top, said clearance cooperating with said gasket opposite ends and length portions of said flange first and second walls exposed in said clearance to define a site for a compartment serving as a repository for an adhesive mass;

d. A rectangular glass window sized to fit within said window opening having an operative position disposed upon said gasket length portions such that a top of said window is in spanning relation therebetween and is presented as a side of said compartment-repository for an adhesive mass; and e. Urethane selected as said adhesive mass used in an amount filling said compartment such that said adhesive is in contact with said top of said glass window bounding said compartment;

whereby said urethane cures in a rectangular configuration serving both as an adhesive attachment along said glass window top and as a hinge permitting limited pivotal traverses thereof.

2. The pivotally traversable vehicle window as claimed in claim 1 wherein both said flange and said weather-barrier gasket means are of selected lengths and have operative positions disposed in encircling relation about said window opening, with said gasket means being adhesively secured to said flange second wall, whereby said gasket means and said cured rectangular configuration of urethane contribute to providing a weather seal for said window.

3. The pivotally traversable vehicle window as claimed in claim 2 including latch means connected between said wall means edge bounding said bottom of said window opening and a bottom of said glass window effective to limit an opening pivotal traverse of said glass window to a nominal angular extent as permitted by the resiliency of said cured rectangular configuration of said urethane, to thereby contribute to said urethane serving as a hinge and said glass window providing ventilating service for said vehicle.

* * * * *